US005505404A

United States Patent [19]

Dubreuil

[11] Patent Number: 5,505,404

[45] Date of Patent: Apr. 9, 1996

[54] HOSE WINDING APPARATUS

[76] Inventor: Christian Dubreuil, 261-A, St-Martin, Napierville, Quebec, Canada, J0J 1L0

[21] Appl. No.: 372,341

[22] Filed: Jan. 13, 1995

[51] Int. Cl.[6] ..... B65H 75/40

[52] U.S. Cl. ..... 242/532.6; 242/395; 242/397.5

[58] Field of Search ..... 242/395, 397, 242/397.1, 397.2, 397.3, 397.4, 397.5, 398, 402, 405.3, 532.6; 137/355.26, 355.27; 100/168, 176

[56] References Cited

U.S. PATENT DOCUMENTS

| | | | |
|---|---|---|---|
| 2,933,262 | 4/1960 | Fish | 242/532.6 |
| 3,072,384 | 1/1963 | Apichell | 242/397.5 |
| 3,124,321 | 3/1964 | Rylott . | |
| 4,057,198 | 11/1977 | Whitfield . | |
| 4,228,553 | 10/1980 | Genuit | 242/397.1 |
| 4,265,414 | 5/1981 | Spradling | 242/397.5 |
| 4,288,047 | 9/1981 | Berry et al. | 242/395 |
| 5,033,690 | 7/1991 | Metver . | |
| 5,308,011 | 5/1994 | Roman | 242/395 |
| 5,388,609 | 2/1995 | Ghio et al. | 242/397 |

*Primary Examiner*—John P. Darling
*Attorney, Agent, or Firm*—Louis Tessier

[57] ABSTRACT

An hose winding apparatus for winding fire hoses. The apparatus has a base member and an upwardly extending vertical support structure. An horizontal support structure extends frontwardly from the vertical support structure. A manual reel having a crank handle is provided for winding the hose. The reel is positioned on the distal end of the horizontal support structure. A pair of squeezing rollers are mounted on the vertical support structure. The squeezing rollers are adapted to squeeze the hose into a flat configuration as it is being wound on the reel. A foot operated mechanism allows the user to temporarily separate the squeezing rollers so as to allow passage of the coupling components at both ends of the hose. A stopper plate is pivotally mounted underneath the horizontal support structure. The stopper plate is adapted to prevent the coupling components from swinging freely and from injuring the user. An abutment plate extends rearwardly from the vertical support structure. A pair of guiding rollers are mounted on the abutment plate. The guiding rollers are movable relatively to one another so as to allow adjustment to hoses having various diameters.

8 Claims, 4 Drawing Sheets

10
12
14
16
18
20
22
24
26
28
30
32
34
36
52
53
56
58
60
64
66
68
70
72
74
76
78
80
82
83
84
85
86
88
89
90
92
94
98
100
102
104
106
108
122
124
128
130
132
134
II
II

HOSE WINDING APPARATUS

BACKGROUND

1. Field of the Invention

The present invention relates to the field of winding apparatuses and is particularly concerned with a device for winding fire hoses.

Prior Art

Winding of fire hoses, especially when performed manually, is a tedious and unergonomical operation. Before the manual winding operation is begun, the fire fighter must first drain the water from the hose and arrange the latter into a straight line. The fire fighter then manually winds the hose into a convolute roll while being positioned on hands and knees.

The winding of fire hoses is typically performed quite routinely by fire fighting personnel. For example, after a fire fighting operation, each length of fire hose must be wound up at the scene of the fire for the return trip to the fire station. At the station the hose must be unrolled and placed on drying racks and then wound up again for storage. In some areas, safety regulations require that all fire hoses be unwound and inspected at regular intervals and, of course, the hose must be rewound for storage.

Accordingly, the prior art is replete with apparatuses for winding fire hoses. However, because of the complexity of the designs of the prior art structures and of the non satisfactory results obtained through the use of these structures, no known device has reached a satisfactory level of commercial acceptance.

One of the main disadvantages inherent to prior art structures is their incapacity to sufficiently compress or otherwise act upon the hose so as to drain water from the hose during the winding operation. Therefore, when using these prior art devices, the hose must be drained as a step preparatory to winding that causes time delays and unnecessary manipulation.

Another main disadvantage of prior art devices relates to the fact that these devices are unergonomical to handle and are even susceptible of causing injuries to the user,

SUMMARY OF THE INVENTION

Accordingly, it is an object of the present invention to provide an improved hose winding apparatus. The hose winding apparatus in accordance with the present invention will allow a user to readily and ergonomically wind a conventional fire hose using simple operational steps.

The hose winding apparatus in accordance with the present invention will allow a user to exert a compression on the hose as it is being wounded so as to drain the latter during the actual winding operation.

The hose winding apparatus in accordance with the present invention will allow a user to exert a controllable compressive force on the hose as it is being winded so as to adapt to various situations.

The hose winding apparatus in accordance with the present invention will allow a user to wind hoses of different widths without having to make lengthy adjustments on the winding apparatus.

The hose winding apparatus in accordance with the present invention will be provided with means for reducing the risk of injury to the user performing the winding operation.

The hose winding apparatus in accordance with the present invention will conform to conventional forms of manufacturing, be of simple construction and easy to use, as to provide a hose winding apparatus which will be economically feasible, long lasting and relatively trouble-free in operation.

According to one embodiment of the present invention there is provided a hose winding apparatus for winding a hose the hose having a pair of longitudinally opposed free ends, the apparatus comprising a base member having a base front end and a base rear end, a vertical support structure extending substantially upwardly from the base member, an horizontal support structure extending substantially frontwardly from the vertical support structure, a hand-operated reel means for winding the hose, the reel means being mounted on the horizontal support structure, a first squeezing roller rotatably attached to the vertical support structure, a second squeezing roller rotatably attached to the vertical support structure, the first and second squeezing rollers being movable between a first roller position wherein the first and second squeezing rollers are in abutting contact with one another and a second roller position wherein the rollers are spaced apart from each other, a foot operated mechanism operatively attached to at least one of the squeezing rollers for allowing the rollers to be moved between the first roller position and the second roller position whereby, the foot operated mechanism is adapted to be used for moving the rollers into the second position so as to allow insertion of the hose between the rollers, the rollers being adapted to squeeze the hose into a substantially flat configuration as the latter is bring winded on the hand operated reel means.

Preferably the device includes a stopper plate extending substantially frontwardly from the vertical support structure intermediate the horizontal support structure and the base member whereby, the stopper plate is adapted to prevent one of the free ends of the hose from contacting a user during the winding operation.

Conveniently, the device includes an abutment plate extending substantially rearwardly from the vertical support structure and a pair of hose guiding rollers mounted on the abutment plate, the hose guiding rollers being adapted to guide the hose as the latter is being winded on the hand operated reel means.

Preferably, the vertical support structure comprises a pair of main posts extending substantially upwardly from the base member in a substantially parallel and spaced apart relationship relatively to one another, each of the main post having a main post upper end and a main post lower end, each of the main post lower end being rigidly fixed to the base member; the vertical support structure further comprising a squeezing roller guiding means for guiding the movement of one of the squeezing rollers between the first roller position and the second roller position; the foot operated mechanism comprising a first transmission rod, the first transmission rod being pivotally fixed at one of its longitudinal end to one of the squeezing rollers, a second transmission rod, the second transmission rod being pivotally fixed at one of its longitudinal end to the first transmission rod, a spacing member extending substantially upwardly from the base member, a pedal means fixed to the second transmission rod, the second transmission rod being rotatably fixed to the spacing member intermediate the pedal means and the first transmission rod whereby, when a user exerts a downward foot pressure on the pedal means, one of the squeezing rollers is translated upwardly along the squeezing roller guiding means.

Conveniently, the stopper plate has a stopper plate frontward end and a stopper plate rearward end, the stopper plate rearward end is pivotally fixed to the vertical support structure, a stopper plate locking means is fixed to the stopper plate for releasably locking the stopper plate in a predetermined spaced relationship relatively to the horizontal support structure.

Preferrably, the stopper plate has a substantially arcuate configuration and wherein the stopper plate frontward end has a substantially upwardly oriented flat segment.

Conveniently, the stopper plate locking means includes a locking bar, the locking bar having a locking bar first end and a locking bar second end, the locking bar first end being pivotally attached to the stopper plate, the locking bar being provided with a set of spaced apart indentations, the indentations being adapted to be releasably anchored to the vertical support structure.

In a prefered embodiment, each of the hose guiding rollers is rotatably mounted on a guiding roller mounting structure; each of the guiding roller mounting structure comprising a hollow cylindrical mounting sleeve, the mounting sleeve being fixed at its lower end to the abutment plate, the guiding roller mounting structure also comprising a substantially "U"-shaped mounting rod, the mounting rod having a sleeve connecting segment, an integrally extending rod spacing segment and an integrally extending roller connecting segment, the sleeve connecting segment being rotatably inserted into the mounting sleeve, the roller connecting segment being rotatably inserted into the hose guiding roller; the abutment plate being provided with a set of adjustment apertures extending therethrough and radially disposed about each of the mounting sleeves, the adjustment apertures being adapted to receive a lower end portion of the roller connecting segment for releasably locking the hose guiding rollers in a predetermined relationship relatively to one another.

BRIEF DESCRIPTION OF THE DRAWINGS

An embodiment of the present invention will now be described, by way of example, in reference to the following drawings in which:

FIG. 3: in a cross-sectional view taken along arrows 2—2 of FIG. 1 illustrates a hose winding apparatus in accordance with an embodiment of the present invention, the device is shown in a position wherein a hose is being inserted into it;

DETAILED DESCRIPTION

Figure 1:
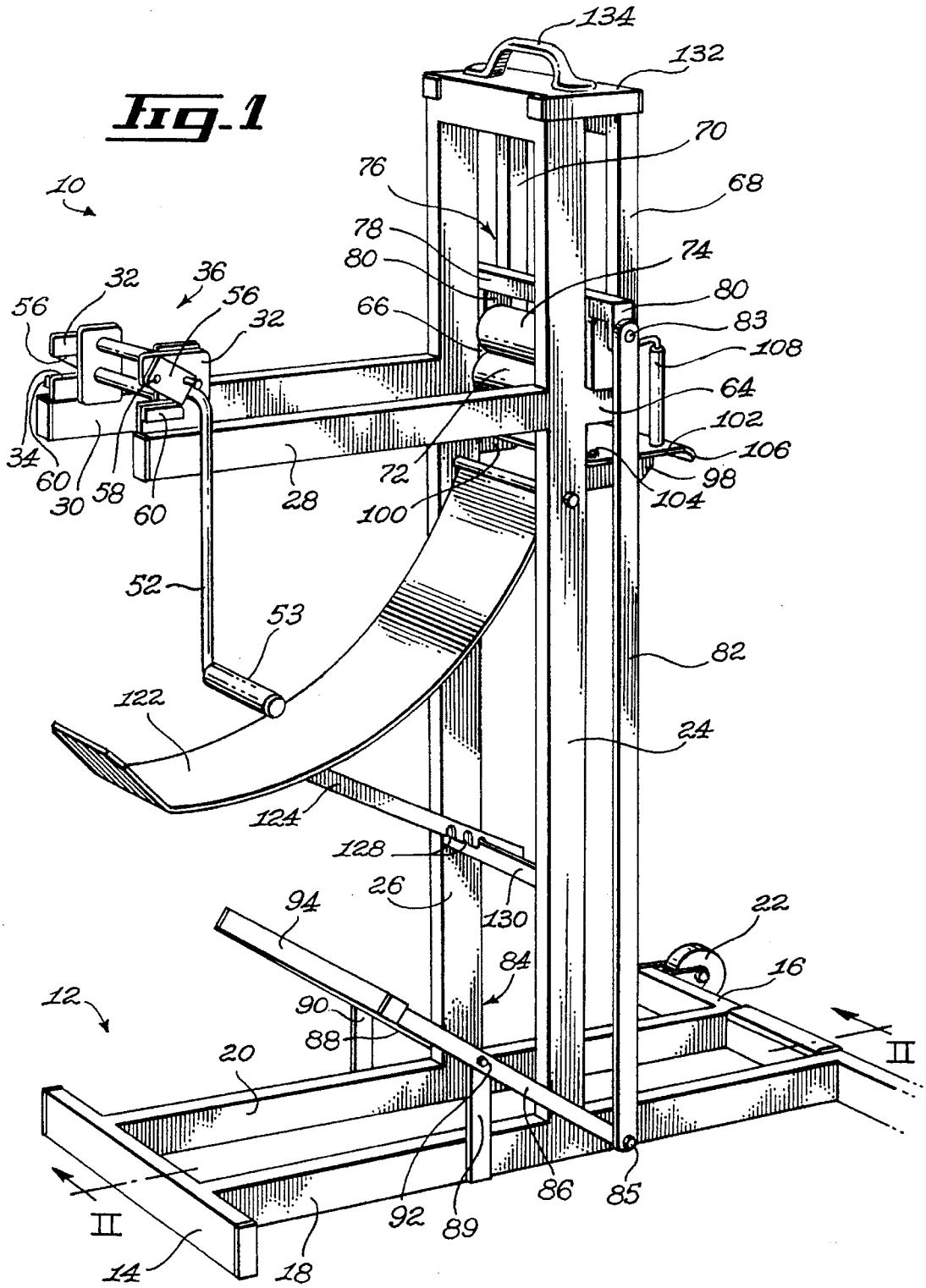
FIG. 1: in a perspective view, illustrates a hose winding apparatus in accordance with an embodiment of the present invention.
Figure 1:
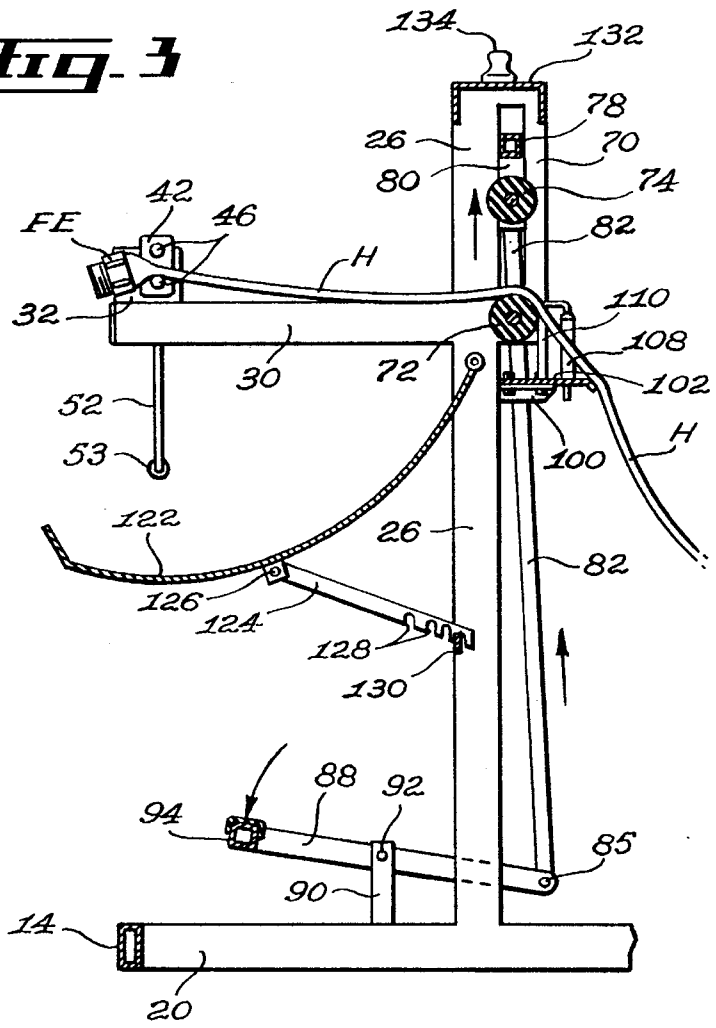

Referring to FIG. 1, there is shown a perspective view of a hose winding apparatus 10 in accordance with an embodiment of the present invention. The winding apparatus 10 comprises a base 12 adapted to be abuttingly rested on the ground surface.

The base 12 typically comprises a substantially elongated base front tubular member 14, a substantially elongated base rear tubular member 16 and a pair of substantially elongated base side tubular members 18 and 20. The base front tubular member 14 and the base rear tubular member 16 are in a substantially parallel relationship with each other while both the base side tubular members 18 and 20 are also in a substantially parallel relationship with each other.

The base side tubular members 18 and 20 each have a front longitudinal end and a rear longitudinal end. The front and rear longitudinal ends of the base side tubular members 18 and 20 are rigidly fixed respectively to the base front tubular member 14 and the base rear tubular member 16 in a substantially perpendicular relationship with them.

The base front tubular member 14 and the base rear tubular member 16 each have opposed longitudinal ends. The base front tubular member 14 and the base rear tubular member 16 are typically sized so that their respective opposed longitudinal ends extends beyond the base side tubular members 18 and 20, thus increasing the size of the sustentation polygon formed by the base 12. A pair of wheels 22 are rotatably mounted to the base rear tubular member 16 adjacent the opposed longitudinal ends of the latter.

The winding apparatus 10 comprises a pair of main tubular members 24 and 26. Both main tubular members 24 and 26 have a substantially elongated configuration defining an upper longitudinal end and a lower longitudinal end. The lower longitudinal ends of the main tubular members 24 and 26 are fixed respectively to the base side tubular members 18 and 20 intermediate the base front tubular member 14 and the base rear tubular member 16. The main tubular members 24 and 26 are in a substantially parallel relationship with each other and are also in a substantially perpendicular relationship with the base side tubular members 18 and 20.

A pair of front spacing tubular members 28 and 30 extend respectively from the main tubular members 24 and 26 in a substantially perpendicular relationship relatively to the them. The front spacing tubular members 28 and 30 both have a substantially elongated configuration defining a frontward end and a rearward end. The rearward end of the front spacing tubular members 28 and 30 is rigidly fixed respectively to the main tubular members 24 and 26 intermediate their respective upper end and lower ends.

A pair of substantially "U"-shaped reel guiding plates 32 are fixed to the front spacing tubular members 28 and 30 adjacent their frontward end. Each reel guiding plate 32 is provided with a supporting indentation 34 extending through its frontwardmost surface. The reel guiding plates 32 are adapted to releasably support and guide a reel assembly 36.

Figure 8:
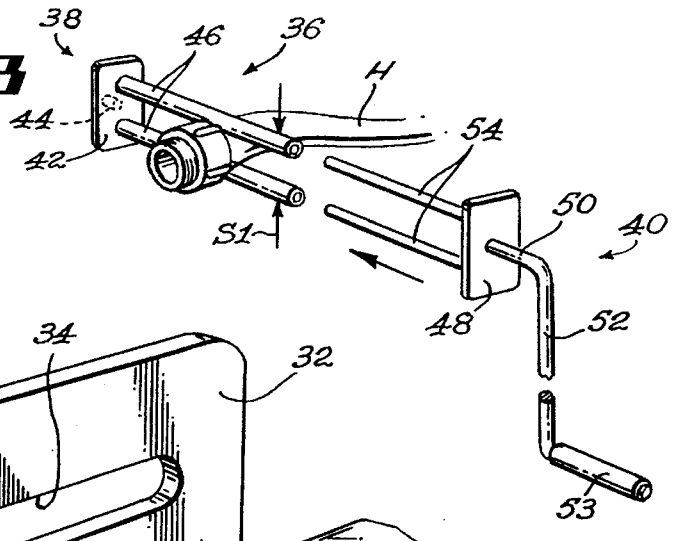
FIG. 8: in a perspective view illustrates a section of a hose being inserted in a reel assembly part of a hose winding apparatus in accordance with an embodiment of the present invention.

As illustrated more specifically in FIG. 8, the reel assembly 36 comprises a first hose supporting component 38 and a second hose supporting component 40. The first hose supporting component 38 and the second hose supporting component 40 are adapted to cooperate with each other for supporting a hose such as the fire hose designated by the reference letter H, and for rotating the latter during the winding operation.

The first hose supporting component 38 has a first component plate 42 defining a first plate inner surface and a first plate outer surface. A first supporting pin 44 extends integrally from the outer surface of the first component plate 42. A pair of hollow tubular members 46 extend integrally and substantially perpendicularly from the inner surface of the first component plate 42. The hollow tubular members 46 are spaced apart from each other by a spacing indicated in FIG. 8 by the reference character S1.

The second hose supporting component 40 has a second component plate 48 defining a second plate inner surface and a second plate outer surface. A second supporting pin 50 extends integrally from the outer surface of the second component plate 48. The second supporting pin 50 extends integrally into a substantially "L"-shaped crank handle 52. The crank handle 52 is preferably provided with a rotatable sleeve 53.

A pair of tine members 54 extends integrally and substantially perpendicularly from the inner surface of the second component plate 48. The tine members 54 are configured, positioned and sized so as to be slidably insertable into the corresponding hollow tubular members 46 part of the first hose supporting component 38.

When the reel assembly 36 is in an assembled configuration, as illustrated in FIG. 1, the tine members 54 are inserted in the hollow tubular members 46. Furthermore, in this configuration, the first supporting pin 44 and the second supporting pin 50 are rotatably supported by the supporting indentations 34 extending through the reel guiding plates 32.

A reel releasable locking means is mounted on the reel guiding plates 32 for preventing unwanted withdrawal of the first supporting pin 44 and the second supporting pin 50 from the supporting indentations 34. The reel locking means comprises a pair of locking plates 56 pivotally mounted on the exterior surface of the reel guiding plates 32 by a plate pivoting pin 58. Each locking plate 56, when in its locking position, is adapted to abut against a corresponding abutment block 60. A corresponding pair of lock handles 62 fixed to the locking plates 56 are adapted to their facilitate prehension and manipulation.

Figure 9:
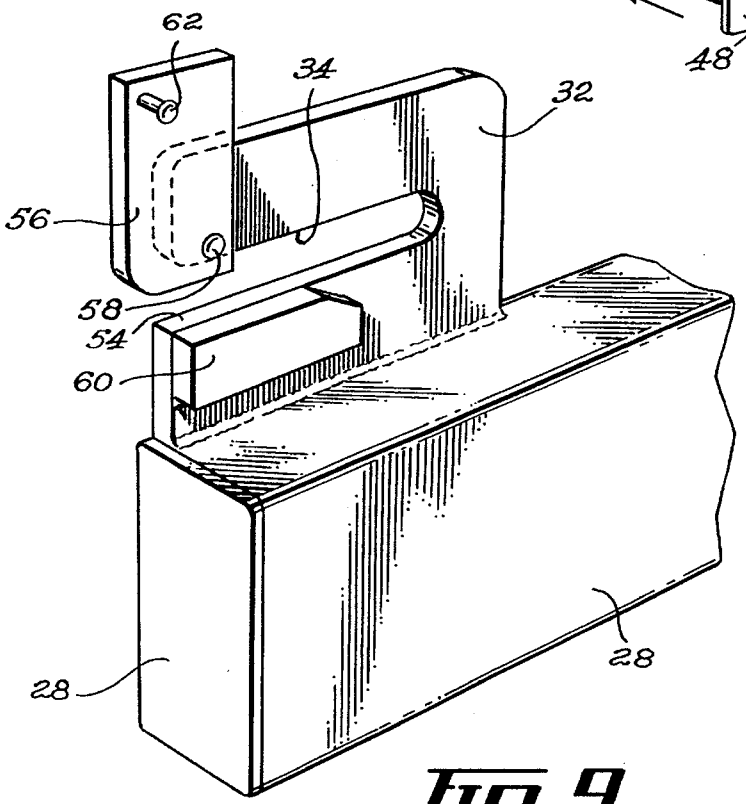
FIG. 9: in a partial perspective view illustates a reel guiding plate part of a hose winding apparatus in accordance with an embodiment of the present invention, the guiding plate is shown with its locking mechanism in an opened configuration.
Figure 10:
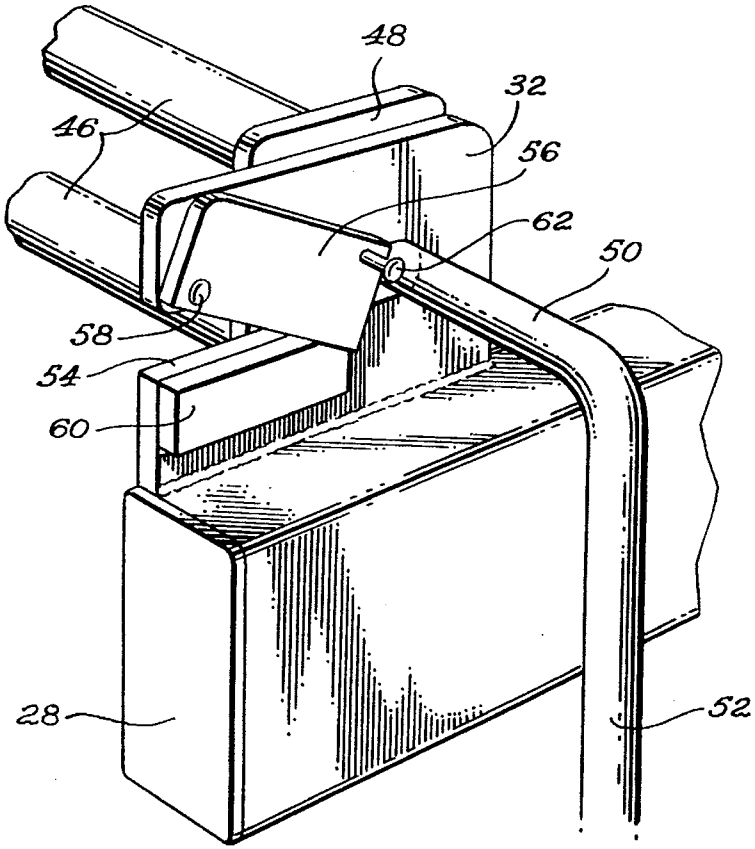
FIG. 10: in a partial perspective view illustates a reel guiding plate part of a hose winding apparatus in accordance with an embodiment of the present invention, the guiding plate is shown with its locking mechanism in a closed configuration.

The locking plates 56 are adapted to pivot between a locked position illustrated in FIG. 10 wherein the locking plates 56 prevent unwanted withdrawal of the first supporting pin 44 and the second supporting pin 50 from the corresponding supporting indentations 34 and an unlocked position illustrated in FIG. 9 wherein the locking plates 56 allow slidable disengagement of the first supporting pin 44 and the second supporting pin 50 from their respective supporting indentations 34. When the locking plates 56 are in their unlocked position, the reel assembly 36 can thus be completely removed from the reel guiding plates 32.

A pair of rear spacing tubular members 64 and 66 extend respectively from the main tubular members 24 and 26 in a substantially perpendicular relationship relatively to them. The rear spacing tubular members 64 and 66 are in a substantially collinear relationship with the front spacing tubular members 28 and 30. The rear spacing tubular members 64 and 66 are typically relatively shorter than the front spacing tubular members 28 and 30. The rear spacing tubular members 64 and 66 both have a frontward end and a rearward end. The frontward end of the rear spacing tubular members 64 and 66 is rigidly fixed respectively to the main tubular members 24 and 26 intermediate their upper end and lower end.

Figure 2:
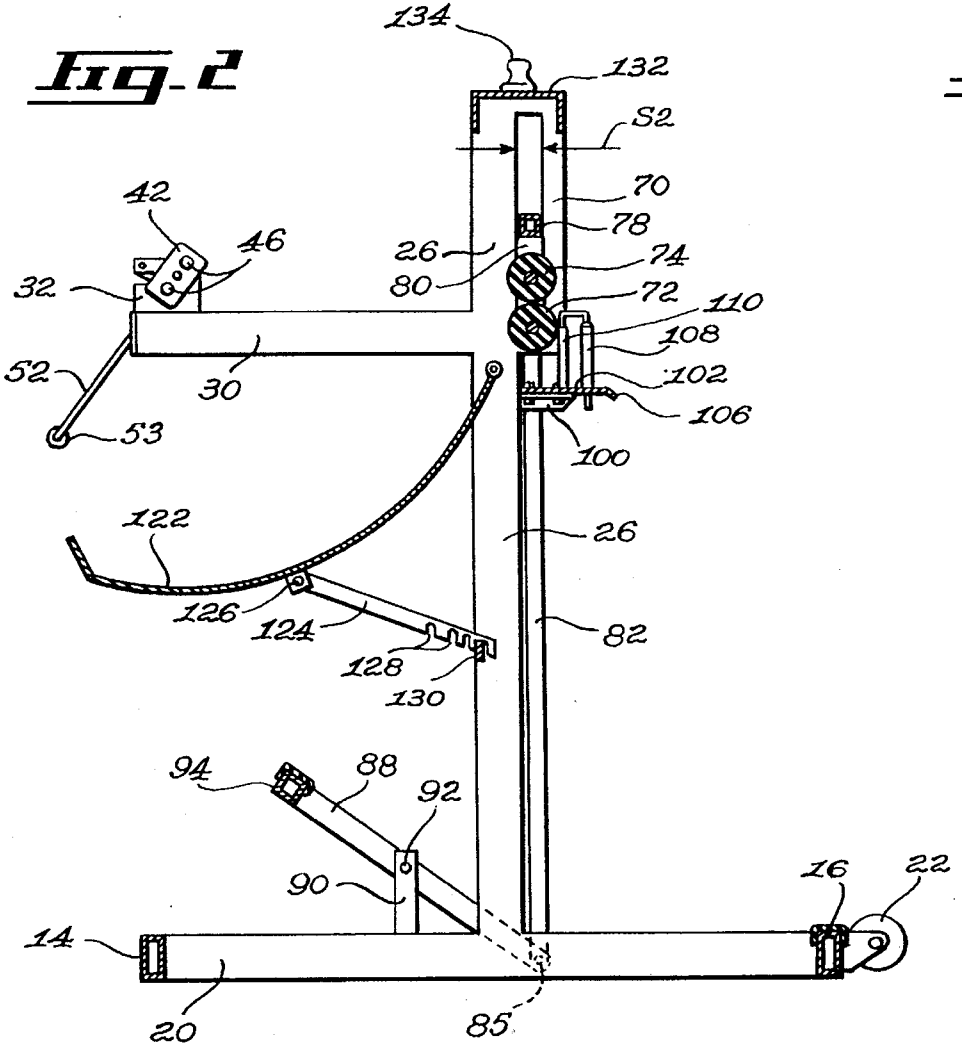
FIG. 2: in a cross-sectional view taken along arrows 2—2 of FIG. 1 illustrates a hose winding apparatus in accordance with an embodiment of the present invention.

A pair of guiding tubular members 68 and 70 extend substantially upwardly and perpendicularly from the rear spacing tubular members 64 and 66 adjacent their rearward end. The guiding tubular members 68 and 70 are in a substantially parallel relationship relatively to the main tubular members 24 and 26. The guiding tubular members 68 and 70 are spaced from the main tubular members 24 and 26 by a spacing indicated in FIG. 2 by the reference character S2.

A first squeezing roller 72 is rotatably mounted between the rear spacing tubular members 64 and 66. A second squeezing roller 74 is rotatably mounted to a roller frame assembly 76. The squeezing rollers 72 and 74 are adapted to cooperate for squeezing the fire hose H during the winding operation so as to drain the water from the hose and flatten the latter in order to provide a compact convolute roll.

The roller frame assembly 76 has a generally "U"-shaped configuration. The roller frame assembly 76 comprises a roller frame transversal member 78. A pair of roller frame supporting members 80 extend perpendicularly from the roller frame transversal member 78 adjacent their longitudinal ends. The second squeezing roller 74 is rotatably mounted between the roller frame supporting members 80.

The roller frame assembly 76 is adapted to translate along the guiding tubular members 68 and 70 in the spacings S2 which extends between the main tubular member 24 and the guiding tubular member 68 as well as between the main tubular member 26 and the guiding tubular member 70.

One of the main features of the present invention resides in the capacity of the first squeezing roller 72 and the second squeezing roller 74 to be moved relatively to one another by a foot actuated mechanism. The foot actuated mechanism comprises a pair of first transmission rods 82 and 84. The first transmission rods 82 and 84 each have an upper end and a lower end.

The upper end of the first transmission rods 82 and 84 is pivotally attached to the roller frame transversal member 78 by a pair set of pivoting pins 83. The foot actuated mechanism also comprises a pair of second transmission rods 86 and 88. The second transmission rods 86 and 88 each has a frontward end and a rearward end. The rearward end of the second transmission rods 86 and 88 are respectively each pivotally attached to an adjacent lower end of the corresponding first transmission rods 82 and 84 by a set of pivoting pins 85.

A pair of base spacing members 89 and 90 extend upwardly and substantially perpendicularly from the base tubular members 18 and 20 intermediate the front tubular member 14 and the main tubular members 24 and 26. The second transmission rods 86 and 88 are pivotally connected respectively to the base spacing members 89 and 90 by a corresponding pair of base pivoting pins 92.

A pedal tubular member 94 extends between the frontward end of the second transmission rods 86 and 88. An anti-skid-type coating, for example in the form of a strip of rubber like material is preferably provided on the upper surface of the pedal tubular member 94.

When a downward pressure is applied to the pedal tubular member 94, for example by the foot of a user, the pedal tubular member 94 transmits the downward pressure to the second transmission rods 86 and 88 which rotate about the base pivoting pins 92. The pivotal action of the second transmission rods 86 and 88 causes their rearward end to be raised.

The upward movement of the rearward end of the second transmission rods 86 and 88 is in turn transmitted to the roller frame assembly 76 by the first transmittal rods 82 and 84. A downward pressure applied to the pedal tubular member 94 thus causes the second squeezing roller 74 to translate upwardly away from the first squeezing roller 72. Conversely, an upward motion of the pedal tubular member 94 causes the second squeezing roller 74 to translate downwardly towards the first squeezing roller 72.

The pivoting pins 83 and 85 allow the arc-shaped trajectory of the rearward end of the second transmission rod 86 and 88 to be transformed into a translational motion of the roller frame assembly 76 which is guided by the main tubular members 24 and 26 as well as the guiding tubular members 68 and 70.

A pair of rearwardly extending plate supporting tubular members 98 and 100 are rigidly connected respectively to the main tubular members 24 and 26. The plate supporting tubular members 98 and 100 are in a substantially parallel relationship with the rear spacing tubular members 64 and 66. The plate supporting tubular members 98 and 100 are preferably located underneath and adjacent the rear spacing tubular members 64 and 66.

An abutment plate 102 is mounted on the plate supporting tubular members 98 and 100. The abutment plate 102 is fixed to the plate supporting tubular members 98 and 100 by fastening means such as bolts 104 which extend through a set of corresponding fixing apertures provided in the abutment plate 102. The rearward peripheral edge 106 of the plate 102 has a substantially downwardly curved general configuration.

A pair of hose guiding rollers 108 are mounted on the abutment plate 102 by a corresponding pair of hose guiding roller mounting structures. The hose guiding roller mounting structures are adapted to allow the hose guiding rollers 110 to pivot relatively to one another so as to allow the hose guiding rollers 118 to abuttingly guide hoses having different widths.

Figures 4, 5, 6, 7:
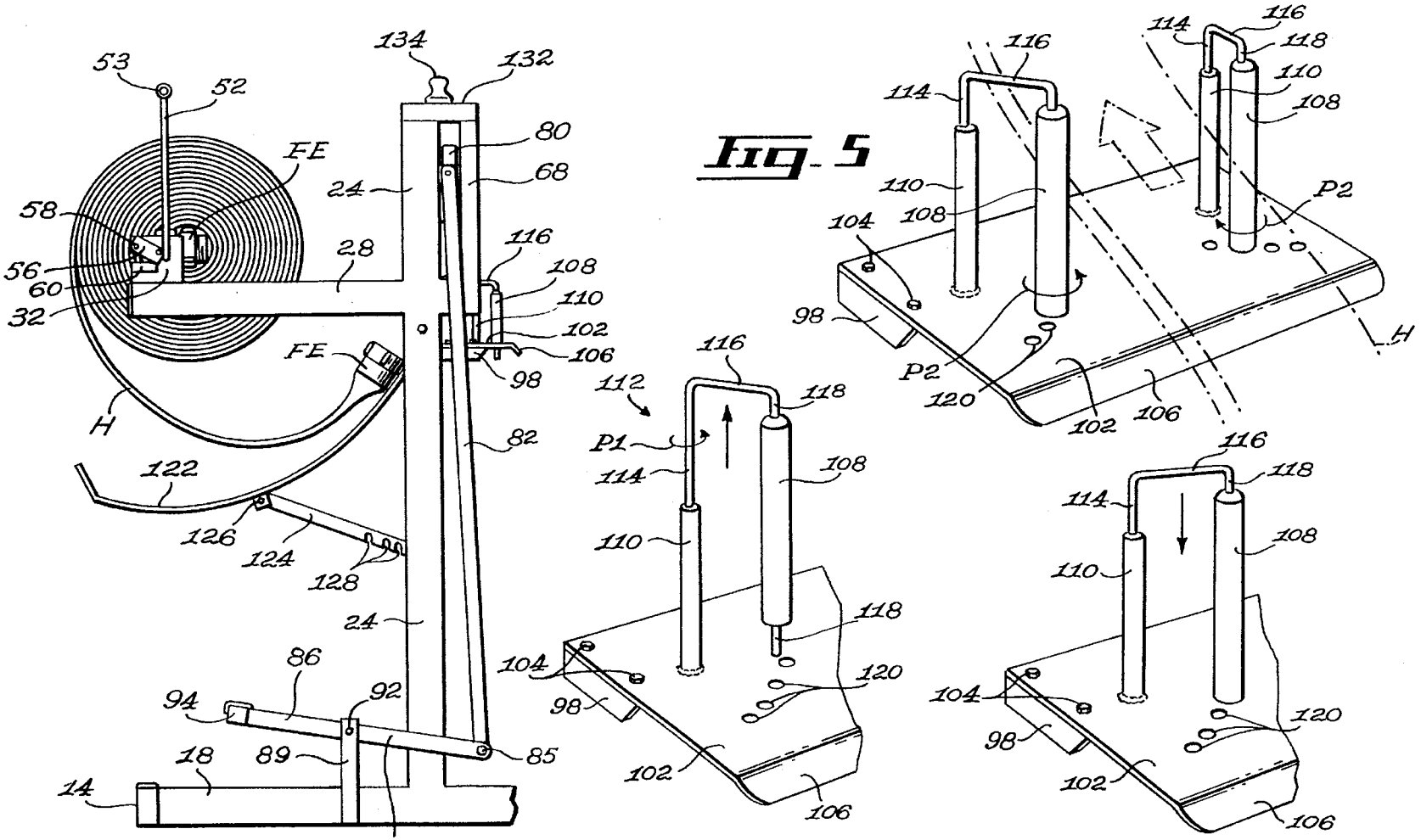
FIG. 4: in an elevational view illustrates a hose winding apparatus in accordance with an embodiment of the present invention, the device is shown with a hose being winded on it.
FIG. 5: in a perspective view illustates a guiding mechanism part of a hose winding apparatus in accordance with an embodiment of the present invention.
FIG. 6: in a partial perspective view illustrates part of a guiding mechanism of a hose winding apparatus in accordance with an embodiment of the present invention, the guiding mechanism is shown in an unlocked configuration.
FIG. 7: in a partial perspective view illustrates part of a guiding mechanism of a hose winding apparatus in accordance with an embodiment of the present invention, the guiding mechanism is shown in a locked configuration.

As illustrated more specifically in FIGS. 5 through 7, each hose guiding roller mounting structure comprises a hollow cylindrical mounting sleeve 110 fixed at its lower end to the abutment plate 102. Each hose guiding roller mounting structure also comprises a substantially "U"-shaped mounting rod 112. Each mounting rod 112 has a sleeve connecting segment 114, a rod spacing segment 116 and a roller connecting segment 118. Each sleeve connecting segment 114 is adapted to be inserted into a corresponding mounting sleeve 110. Each hose guiding roller 108 is provided with a longitudinal channel extending therethrough. Each roller connecting segment 118 is adapted to be inserted in a corresponding longitudinal channel of a hose guiding roller 108. The sleeve connecting segment 114 is adapted to rotate about its longitudinal axis as indicated by arrows P1 inside the corresponding mounting sleeve 110. Each guiding roller 108 is adapted to rotate about its longitudinal axis as illustrated by arrows P2 around its corresponding roller connecting segment 118.

The abutment plate 102 is also provided with a set of adjustment apertures 120 extending therethrough. The adjustment apertures 120 are radially disposed about the mounting sleeves 110. The adjustment apertures 120 are adapted to lockingly receive a lower longitudinal end part of the roller connecting segments 118 for releasably locking a pair of hose guiding rollers 108 in a predetermined spaced relationship relatively to one another.

The rotation of the sleeve connecting segments 114 about their longitudinal axis thus allows for the distance between the hose guiding rollers 108 to be adjusted according to the width of the hose H being winded. Typically, the adjustment apertures 120 are disposed in order to allow for the hose guiding rollers 108 to be spaced from each other by standard distances such as one and a half inch, one and three quarter inches, two and a half inches three and four inches that correspond to conventional hose diameter values.

Another main characteristic of the present invention resides in the presence of a stopper plate 122. The stopper plate 122 has a generally curved configuration. The stopper plate 122 has a proximal end and a distal end. The stopper plate 122 is bended into a substantially flat segment adjacent its distal end. The proximal ends of the stopper plate 122 is pivotally fixed to the main tubular members 24 and 26. The stopper plate 122 is positioned underneath the front spacing tubular members 28 and 30.

A locking rod 124 is pivotally fixed to the convex surface of the stopper plate 122 by a pivoting pin 126. The locking rod 124 is provided with a set of locking notches 128. The locking notches 128 are adapted to be releasably inserted into a notch receiving member 130 extending between the main tubular members 24 and 26. The locking rod 124 allows the stopper plate 122 to be releasably locked in a predetermined spacing relationship relatively to the front spacing tubular members 28 and 30.

The stopper plate 122 is adapted to prevent the free end FE of the winded hose H from impacting a user at the end of the winding operation. The locking rod 124 thus allows the stopper plate 122 to be positioned according to the diameter of the coil formed by the winded hose.

A solidifying plate 132 is rigidly fixed to the upper end of both main beans 24 and 26 and both guiding tubular members 68 and 70. A prehension handle 134 is fixed to the top surface of the solidifying plate 132. The prehension handle 134 is adapted to facilitate transportation of the winding device 10. The prehension handle 134 allows the winding device 10 to be tilted so that its weight rests on the wheels 22 in order to allow the user to ergonomically pull or push the winding device from one location to another.

The embodiments of the invention in which an exclusive privilege or property is claimed are defined as follows:

1. A hose winding apparatus for winding a hose said hose having a pair of longitudinally opposed free ends, said apparatus comprising:

a base member having a base front end and a base rear end, a vertical support structure extending substantially upwardly from said base member, an horizontal support structure extending substantially frontwardly from said vertical support structure, a hand-operated reel means for winding said hose, said reel means being mounted on said horizontal support structure, a first squeezing roller rotatably attached to said vertical support structure, a second squeezing roller rotatably attached to said vertical support structure, said first and second squeezing rollers being movable between a first roller position wherein said first and second squeezing rollers are in abutting contact with one another and a second roller position wherein said rollers are spaced apart from each other, a foot operated mechanism operatively attached to at least one of said squeezing rollers for allowing said rollers to be moved between said first roller position and said second roller position whereby, said foot operated mechanism is adapted to be used for moving said rollers into said second position so as to allow insertion of said hose between said rollers, said rollers being adapted to squeeze said hose into a substantially flat configuration as the latter is bring wound on said hand operated reel means.

2. A hose winding apparatus as recited in claim I wherein said vertical support structure comprises a pair of main posts extending substantially upwardly from said base member in a substantially parallel and spaced apart relative relatively to one another, each of said main post having a main post upper end and a main post lower end, each of said main post lower ends being rigidly fixed to said base member; said vertical support structure further comprising a squeezing roller guiding means for guiding the movement of one of said squeezing rollers between said first roller position and said second roller position; said foot operated mechanism comprising a first transmission rod, said first transmission rod being pivotally fixed at one of its longitudinal ends to one of said squeezing rollers, a second transmission rod, said second transmission rod being pivotally fixed at one of its longitudinal ends to said first transmission rod, a spacing member extending substantially upwardly from said base member, a pedal means fixed to said second transmission rod, said second transmission rod being rotatably fixed to said spacing member intermediate said pedal means and said first transmission rod whereby, when a user exerts a downward foot pressure on said pedal means, one of said squeezing rollers is translated upwardly along said squeezing roller guiding means.

3. A hose winding apparatus for winding a hose said hose having a pair of longitudinally opposed free ends, said apparatus comprising:

a base member having a base front end and a base rear end, a vertical support structure extending substantially upwardly from said base member, an horizontal support structure extending substantially frontwardly from said vertical support structure, a hand-operated reel means for winding said hose, said reel means being mounted on said horizontal support structure, a stopper plate extending substantially frontwardly from said vertical support structure intermediate said horizontal support structure and said base member whereby, said stopper plate is adapted to prevent one of said free ends of said hose from contacting a user when said base is being wound.

4. A hose winding apparatus has recited in claim 3 wherein said stopper plate has a stopper plate frontward end and a stopper plate rearward end, said stopper plate rearward end is pivotally fixed to said vertical support structure, a stopper plate locking means is fixed to said stopper plate for releasably locking said stopper plate in a predetermined spaced relationship relative to said horizontal support structure.

5. A hose winding apparatus as recited in claim 4 wherein said stopper plate has a substantially arcuate configuration and wherein said stopper plate frontward end has a substantially upwardly oriented flat segment.

6. A hose winding apparatus as recited in claim 4 wherein said stopper plate locking means includes a locking bar, said locking bar having a locking bar first end and a locking bar second end, said locking bar first end being pivotally attached to said stopper plate, said locking bar being provided with a set of spaced apart indentations, said indentations being adapted to be releasably anchored to said vertical support structure.

7. A hose winding apparatus for winding a hose said hose having a pair of longitudinally opposed free ends, said apparatus comprising:

a base member having a base front end and a base rear end, a vertical support structure extending substantially upwardly from said base member, an horizontal support structure extending substantially frontwardly from said vertical support structure, a hand-operated reel means for winding said hose, said reel means being mounted on said horizontal support structure, an abutment plate extending substantially rearwardly from said vertical support structure, a pair of hose guiding rollers mounted on said abutment plate, said hose guiding rollers being adapted to guide said hose as the latter is being wound on said hand operated reel means.

8. A hose winding apparatus as recited in claim 2 wherein each of said hose guiding rollers is rotatably mounted on a guiding roller mounting structure; each of said guiding roller mounting structure comprising a hollow cylindrical mounting sleeve, said mounting sleeve being fixed at its lower end to said abutment plate, said guiding roller mounting structure also comprising a substantially "U"-shaped mounting rod, said mounting rod having a sleeve connecting segment, an integrally extending rod spacing segment and an integrally extending roller connecting segment, said sleeve connecting segment being rotatably inserted into said mounting sleeve, said roller connecting segment being rotatably inserted into said hose guiding roller; said abutment plate being provided with a set of adjustment apertures extending therethrough and radially disposed about each of said mounting sleeves, said adjustment apertures being adapted to receive a lower end portion of said roller connecting segment for releasably locking said hose guiding rollers in a predetermined relationship relative to one another.

* * * * *